US007926596B2

(12) United States Patent
Shen et al.

(10) Patent No.: US 7,926,596 B2
(45) Date of Patent: Apr. 19, 2011

(54) DRAG BIT WITH UTILITY BLADES

(75) Inventors: Yuelin Shen, Houston, TX (US); Youhe Zhang, Spring, TX (US)

(73) Assignee: Smith International, Inc., Houston, TX (US)

( * ) Notice: Subject to any disclaimer, the term of this patent is extended or adjusted under 35 U.S.C. 154(b) by 157 days.

(21) Appl. No.: 12/201,516

(22) Filed: Aug. 29, 2008

(65) Prior Publication Data

US 2009/0065263 A1 Mar. 12, 2009

Related U.S. Application Data

(60) Provisional application No. 60/970,373, filed on Sep. 6, 2007.

(51) Int. Cl.
*E21B 17/10* (2006.01)
*E21B 10/60* (2006.01)

(52) U.S. Cl. ..... 175/408; 175/393

(58) Field of Classification Search ..... 175/393, 175/408, 331, 377
See application file for complete search history.

(56) References Cited

U.S. PATENT DOCUMENTS

| | | | | |
|---|---|---|---|---|
| 3,645,346 | A | 2/1972 | Miller et al. | |
| 4,068,731 | A * | 1/1978 | Garner et al. | 175/339 |
| 4,098,362 | A | 7/1978 | Bonnice | |
| 4,253,533 | A | 3/1981 | Baker, III | |
| 4,351,401 | A * | 9/1982 | Fielder | 175/428 |
| 4,467,879 | A | 8/1984 | Burge | |
| 5,010,789 | A | 4/1991 | Brett et al. | |
| 5,163,524 | A | 11/1992 | Newton, Jr. et al. | |
| 5,178,222 | A | 1/1993 | Jones et al. | |
| RE34,435 | E | 11/1993 | Warren et al. | |
| 5,549,171 | A | 8/1996 | Mensa-Wilmot et al. | |
| 5,558,170 | A | 9/1996 | Thigpen et al. | |
| 5,607,024 | A | 3/1997 | Keith et al. | |
| 5,651,421 | A | 7/1997 | Newton et al. | |
| 5,697,461 | A | 12/1997 | Newton et al. | |
| 5,836,404 | A * | 11/1998 | Trujillo et al. | 175/57 |
| 6,006,844 | A | 12/1999 | Van Puymbroeck et al. | |
| 6,112,836 | A | 9/2000 | Spaar et al. | |
| 6,129,161 | A * | 10/2000 | Roberts et al. | 175/393 |
| 6,349,780 | B1 | 2/2002 | Beuershausen | |
| 6,484,825 | B2 | 11/2002 | Watson et al. | |
| 7,083,010 | B2 | 8/2006 | Eppink et al. | |
| 7,117,960 | B2 | 10/2006 | Wheeler et al. | |

(Continued)

FOREIGN PATENT DOCUMENTS

EP 1227214 7/2002

OTHER PUBLICATIONS

Search Report issued by the U.K. Intellectual Property Office in corresponding Application No. GB0816298.4, 2 pages.

(Continued)

*Primary Examiner* — Jennifer H Gay
(74) *Attorney, Agent, or Firm* — Osha Liang LLP

(57) ABSTRACT

A drill bit comprises a bit body and a plurality of cutting blades extending radially from the bit body, the plurality of cutting blades further comprising cutting elements disposed thereon. The drill bit also comprises a plurality of utility blades extending radially from the bit body, the plurality of utility blades being free of cutting elements.

14 Claims, 4 Drawing Sheets

U.S. PATENT DOCUMENTS

| | | | | |
|---|---|---|---|---|
| 7,325,632 | B2 * | 2/2008 | Larsen et al. | 175/339 |
| 2006/0048973 | A1 | 3/2006 | Brackin et al. | |
| 2006/0102389 | A1 | 5/2006 | Wiseman et al. | |
| 2006/0260845 | A1 | 11/2006 | Johnson | |
| 2006/0278436 | A1 * | 12/2006 | Dykstra et al. | 175/57 |
| 2007/0272442 | A1 * | 11/2007 | Pastusek et al. | 175/40 |
| 2008/0060848 | A1 * | 3/2008 | Pastusek et al. | 175/40 |
| 2008/0066959 | A1 * | 3/2008 | Pastusek et al. | 175/39 |
| 2009/0065263 | A1 * | 3/2009 | Shen et al. | 175/393 |
| 2009/0194332 | A1 * | 8/2009 | Pastusek et al. | 175/40 |
| 2010/0051292 | A1 * | 3/2010 | Trinh et al. | 166/378 |

OTHER PUBLICATIONS

"Field Testing of Low-Friction-Gauge PDC Bits"; L.A. Sinor, J.F. Brett, T.M. Warren, and S.M. Behr; Amoco Production Co.; SPE20416; SPE Drilling & Completion; Mar. 1993; pp. 21-27 (7 pages).

"Flexible Bit: A New Anti-Vibration PDC Bit Concept"; P. Defourny, F. Abbassian; Society of Petroleum Engineers, Inc.; SPE30475; SPE Annual Technical Conference & Exhibition, Dallas, Texas, Oct. 22-25, 1995; pp. 263-275 (13 pages).

"Drillstring Stability Based on Variable Material Specific Force and Using a Sharp Three-Insert Polycrystalline Diamond Compact (PDC) Coring Bit"; M. A. Elsayed, L. F. Washington; Journal of Energy Resources Technology, Jun. 2001, vol. 123; pp. 138-143 (6 pages).

Improved Bit Stability Reduces Downhole Harmonics (Vibrations); B. Ortiz, C. Casallas, and H. Parra; International Association of Drilling Contractors/Society of Petroleum Engineers Inc.; IADC/SPE 36413; Asia Pacific Drilling Technology Conference & Exhibition, Kuala Lumpur, Malaysia, Sep. 9-11, 1996; pp. 379-389 (11 pages).

"Development of an Antiwhirl Core Bit"; L.A. Sinor, T.M. Warren, and W.K. Armagost; SPE Drilling & Completion, Sep. 1995; pp. 170-177 (8 pages).

"Innovative Cutting Structure Improves Stability and Penetration Rate of PDC Bits Without Sacrificing Durability"; G. Mensa-Wilmot, T. Krepp; SPE/IADC 39310; IADC/SPE Drilling Conference, Dallas, Texas Mar. 3-6, 1998; pp. 167-175 (9 pages).

"A New Method of Producing Laterally Stable PDC Drill Bits"; S. Johnson, ReedHycalog; IADC/SPE 98986; IADC/SPE Drilling Conference Miami, Florida, Feb. 21-23, 2006; pp. 1-15 (15 pages).

"Innovative Design Processess and Technologies Improve PDC Bit Performance in Harsh Drilling Environments"; G. Mensa-Wilmot, B. Mikhail, M. Al-Saeedi, M. Sounderrajan, D. Al-Enezi, and M. Al-Khaldi; IADC/SPE 103983; IADC/SPE Asia Pacific Drilling Technology Conference and Exhibition, Bangkok, Thailand, Nov. 13-15, 2006; pp. 1-14 (14 pages).

* cited by examiner

DRAG BIT WITH UTILITY BLADES

CROSS REFERENCE TO RELATED APPLICATIONS

This Application claims the priority of a provisional application under 35 U.S.C. §119(e), namely U.S. patent application Ser. No. 60/970,373 filed on Sep. 6, 2007, which is incorporated by reference in its entirety herein.

BACKGROUND

1. Field of the Disclosure

Embodiments disclosed herein relate generally to cutting tools in oilfield applications. More particularly, embodiments disclosed herein relate to drill bits having additional blades to achieve and maintain better stability during drilling operations.

2. Background Art

Rotary drill bits with no moving elements are typically referred to as "drag" bits. Drag bits are often used to drill very hard or abrasive formations. Drag bits include those having cutting elements attached to the bit body, such as polycrystalline diamond compact (PDC) bits, and those including abrasive material, such as diamond, impregnated into the surface of the material which forms the bit body. The latter bits are commonly referred to as "impreg" bits.

An example of a prior art drag bit having a plurality of cutters with ultra hard working surfaces is shown in FIG. 1. The drill bit 10 includes a bit body 12 and a plurality of blades 14 extending radially from the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Orifices are typically formed in the drill bit body 12 and positioned in the gaps 16. The orifices are commonly adapted to accept nozzles 23. The orifices allow drilling fluid to be discharged through the bit in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. Without proper flow characteristics, insufficient cooling of the cutters may result in cutter failure during drilling operations. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate strength and toughness, while providing good resistance to abrasive and erosive wear.

The combined plurality of surfaces 20 of the cutters 18 effectively forms the cutting face of the drill bit 10. Once the crown 26 is formed, the cutters 18 are positioned in the cutter pockets 34 and affixed by any suitable method, such as brazing, adhesive, mechanical means such as interference fit, or the like. The design depicted provides the cutter pockets 34 inclined with respect to the surface of the crown 26. The cutter pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultra hard surface is affixed to a substrate at an angle on a cutter body or a stud so that a desired rake angle is achieved at the working surface.

Polycrystalline diamond cutting elements are frequently used on fixed-head drill bits. One embodiment of polycrystalline diamond includes polycrystalline diamond compact ("PDC"), which comprises man-made diamonds aggregated into relatively large, inter-grown masses of randomly oriented crystals. Polycrystalline diamond is highly desirable, in part due to its relatively high degrees of hardness and wear resistance. Despite these properties, however, polycrystalline diamond will eventually wear down or otherwise fail after continued exposure to the stresses of drilling. Undesirable bit performance such as vibration and whirling while drilling exacerbates wear and tear on the cutting elements.

The use of PDC bits over roller cone bits has grown over the years, largely as a result of greater rates of penetration (ROPs) frequently attainable using a PDC bit. ROP is a major issue in deep wells. Low ROP (for example, 3 to 5 feet per hour) is primarily a result of a high compressive strength of highly overburdened formations encountered at greater depths. Initially, roller cone bits with hardened inserts used for drilling hard formations at shallower depths were applied as wells went deeper. However, at greater depths it is more difficult to recognize when roller cone bit bearings have failed, a situation that can occur with greater frequency when greater weight is applied to the bit in a deep well. This can lead to more frequent failures, lost cones, more frequent trips, higher costs, and lower overall rates of penetration. PDC bits, having no moving parts, provide a solution to some of the problems experienced with roller cone bits.

However, PDC bits are not without their own inherent problems. "Bit whirl" is a problem that may occur when a PDC bit's center of rotation shifts away from its geometric center, producing a non-cylindrical hole. This may result from an unbalanced condition brought on by irregularities in the frictional forces between the rock and the bit, analogous to an unbalanced tire causing vibrations that spread throughout a car at higher speeds. Bit whirl may cause cutters to be accelerated sideways and backwards, causing chipping that may accelerate bit wear, reduce PDC bit life and reduce rate of penetration (ROP). In addition, bit whirl may result in very high downhole lateral acceleration, which causes damage not only to the bit but also other components in the BHA, such as motors, MWD tools and rotary steerable tools. Bit whirl is well documented as a major cause of damage to PDC drill bits, resulting in short runs, low ROP, high cost per foot, poor hole quality and downhole tool damage. Hence, consistent lateral stability may be highly desirable in PDC bits.

PDC bits may also be more susceptible to this phenomenon as well as to "stick slip" problems, where the bit hangs up momentarily, allowing its rotation to briefly stop, and then slips free at a high speed. While PDC cutters are very good at shearing rock, they may be susceptible to damage from the sharp impacts that these problems can lead to in hard rocks, resulting in reduced bit life and lower overall rates of penetration.

Many approaches have been devised to improve drill bit dynamic characteristics to reduce the detrimental effects to the drill bit. In particular, stabilizing features known as "wear knuckles", sometimes interchangeably referred to as "contact pads" or "wear knots", are used to stabilize the drill bit by controlling lateral movement of the bit, lateral vibration, and depth of cut. These stabilizing features project from the bit face, either trailing or leading a corresponding cutting element with respect to a rotational direction about a bit axis.

One characteristic of fixed-head bits having conventional stabilizing features is that the cutting elements extend outwardly of the stabilizing features, to contact the formation in advance of the stabilizing features. The stabilizing features are designed not to contact the formation until the bit advances at a selected minimum rate or depth of cut ("DOC"). In many cases, stabilizing features therefore do not sufficiently support the fragile cutting surface. In other cases, the cutting elements may penetrate further into the formation than predicted by the stabilizing features, so that the cutting tips become overloaded despite the presence of the stabilizing features. Furthermore, the manufacturing process used to create these bits may not allow the accuracy required to consistently reproduce a desired minimum DOC. One or more stabilizing features may contact the formation while others have clearance. This imbalance can introduce additional instability. Therefore, an improved apparatus and method for stabilizing a drill bit are desirable.

Further, bit stability while drilling may be achieved using two methodologies. An active method may be a bit designed to have minimum imbalanced force or desired high imbalanced force in certain directions. A passive method may be a bit designed to use features to suppress the magnitude of instability. In real applications, due to formation inhomogeneity and drill string vibration, a stable bit is often subject to varying load and drills in unstable mode. Thus, passive stability may be desirable on a bit if stability is of interest. Features such as these may be sufficient in providing protection with some lateral vibrations, however, may not provide enough protection from significant whirl and/or torsional vibrations.

Accordingly, there exists a need for improvements in fixed cutter bits, including the passive stability of a bit by reducing the magnitude of instability when vibrations occur during drilling operations.

SUMMARY OF THE DISCLOSURE

In one aspect, embodiments disclosed herein relate to a drill bit comprising a bit body and a plurality of cutting blades extending radially from the bit body, the plurality of cutting blades further comprising cutting elements disposed thereon. The drill bit also comprises a plurality of utility blades extending radially from the bit body, the plurality of utility blades being free of cutting elements.

In one aspect, embodiments disclosed herein relate to a drill bit comprising a bit body and a plurality of cutting blades extending radially from the bit body, the plurality of cutting blades further comprising cutting elements disposed thereon. The drill bit also comprises a plurality of utility blades extending radially from the bit body, the plurality of utility blades being free of cutting elements. The drill bit also comprises flow nozzles attached to a conduit disposed in the utility blades, the flow nozzles configured to direct flow towards the cutting elements disposed on the cutting blades.

In one aspect, embodiments disclosed herein relate to a drill bit comprising a bit body and at least one cutting blade extending radially from the bit body, the cutting blade further comprising cutting elements disposed thereon. The drill bit also comprises at least one utility blade extending radially from the bit body, the utility blade being free of cutting elements.

In one aspect, embodiments disclosed herein relate to a method to achieve improved bit stability in a drill bit, the method comprising rotating the drill bit comprising a plurality of cutting blades with cutting elements alternated with a plurality of utility blades without cutting elements, wherein the utility blades are configured to absorb impact loads.

Other aspects and advantages of the invention will be apparent from the following description and the appended claims.

DETAILED DESCRIPTION

In one aspect, embodiments disclosed herein relate to apparatus and methods involving cutting tools in oilfield applications. More particularly, embodiments disclosed herein relate to drill bits having additional blades to achieve and maintain better stability during drilling operations.

Figure 1:
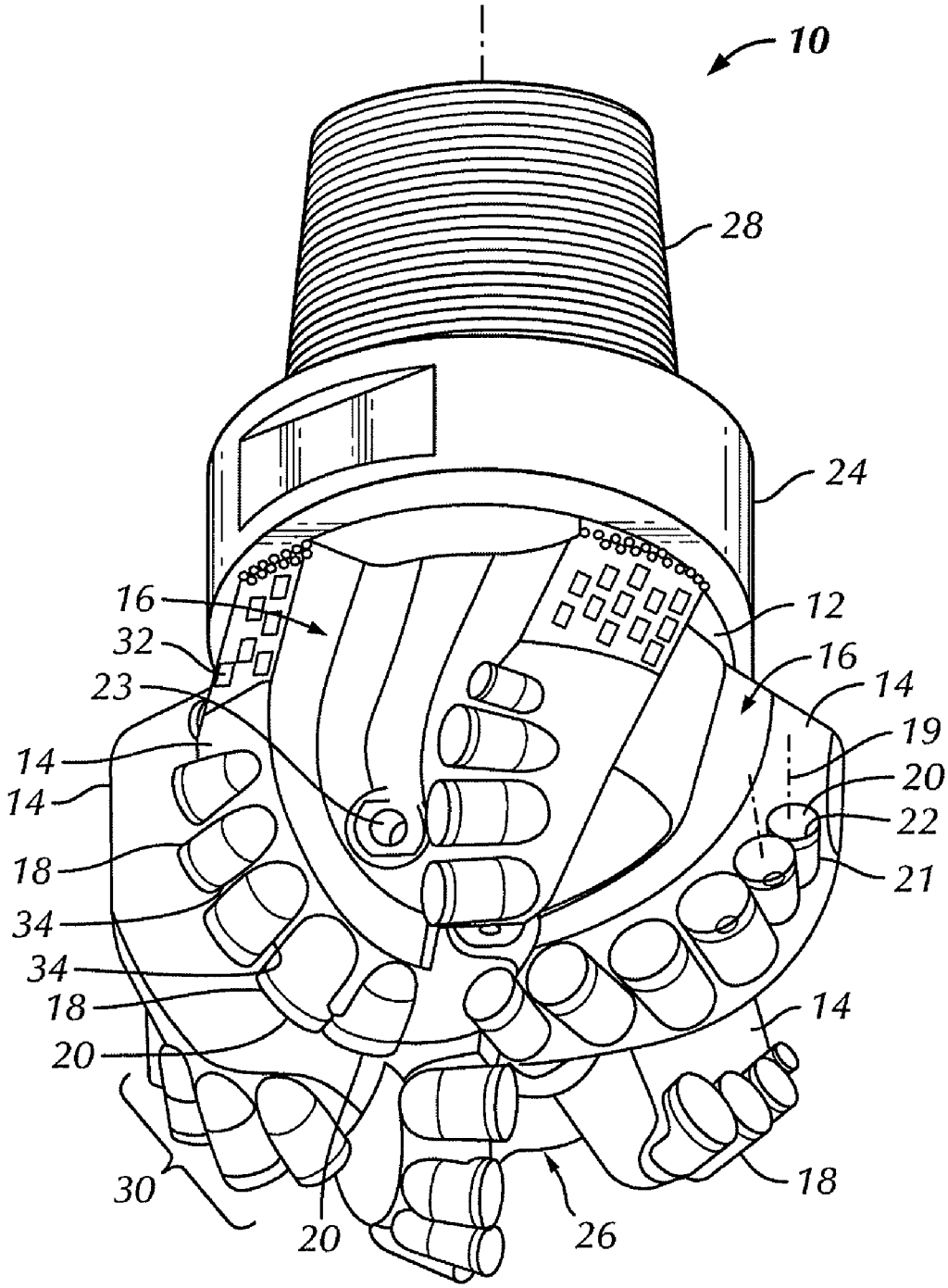
FIG. 1 (Prior Art)
FIG. 1 shows a prior art drag bit.
Figure 2:
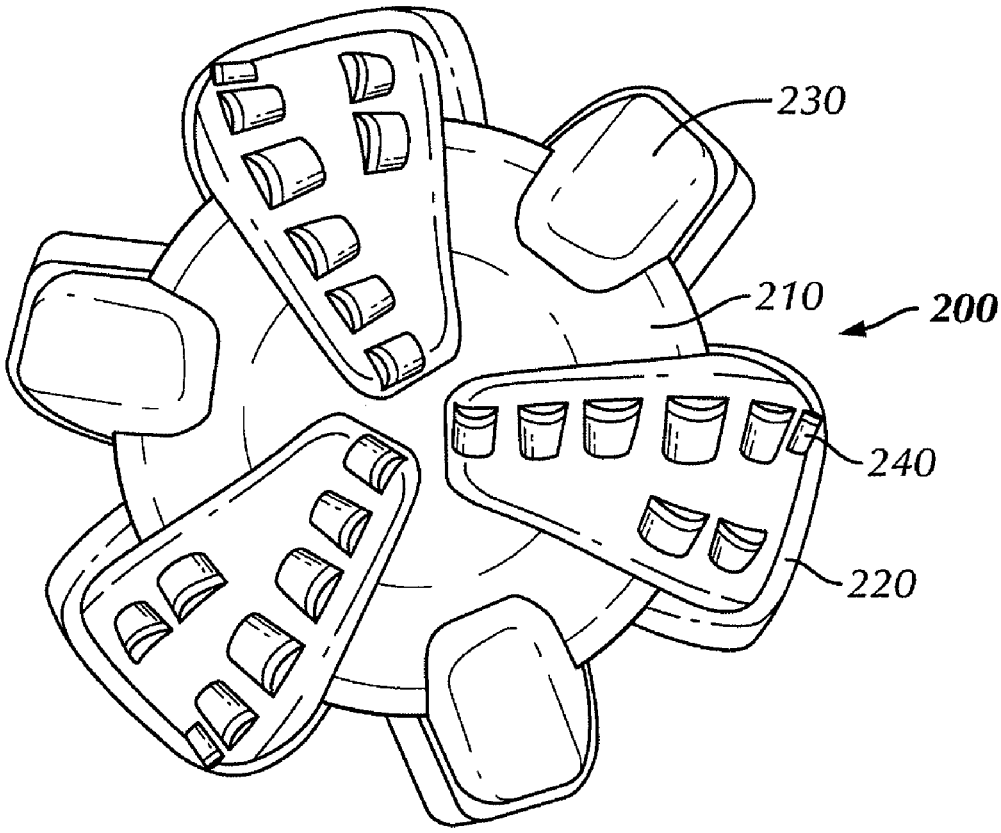
FIG. 2 shows a drill bit comprising utility blades in accordance with embodiments of the present disclosure.

Referring to FIG. 2, a bottom view of a drill bit 200 is shown in accordance with embodiments of the present disclosure. Drill bit 200 comprises a bit body 210, cutting blades 220 extending radially from bit body 210, and cutting elements 240 disposed on cutting blades 220. Drill bit 200 further comprises utility blades 230 extending radially from bit body 210, utility blades 230 being free of cutting elements. As used herein, the term "utility blade" refers to a raised volume or blade having no cutting elements disposed thereon that may be used to provide a variety of utilities or features to the bit. Such utilities or features may include drilling stability improvements, downhole sensing equipment, and cleaning features such as nozzles. In accordance with some embodiments of the invention, the shape and width of the utility blades may be pre-optimized for a given application. Pre-optimization or pre-configuration may be based on simulation or other information.

As shown, utility blades 230 and cutting blades 220 may be arranged in an alternating configuration around a center of bit body 210 however, a person skilled in the art will understand that other suitable arrangements may be possible. Further, while embodiments disclosed herein show three cutting blades and three utility blades, it will be understood by those skilled in the art that varying numbers of cutting blades and utility blades may be used. Still further, cutting elements 240 on cutting blades 220 may have various configurations, for example, varying numbers of cutting elements 240, uneven or even spacing along cutting blade 220, etc. Different configurations of cutting elements 240 will be know to those skilled in the art.

Figure 3:
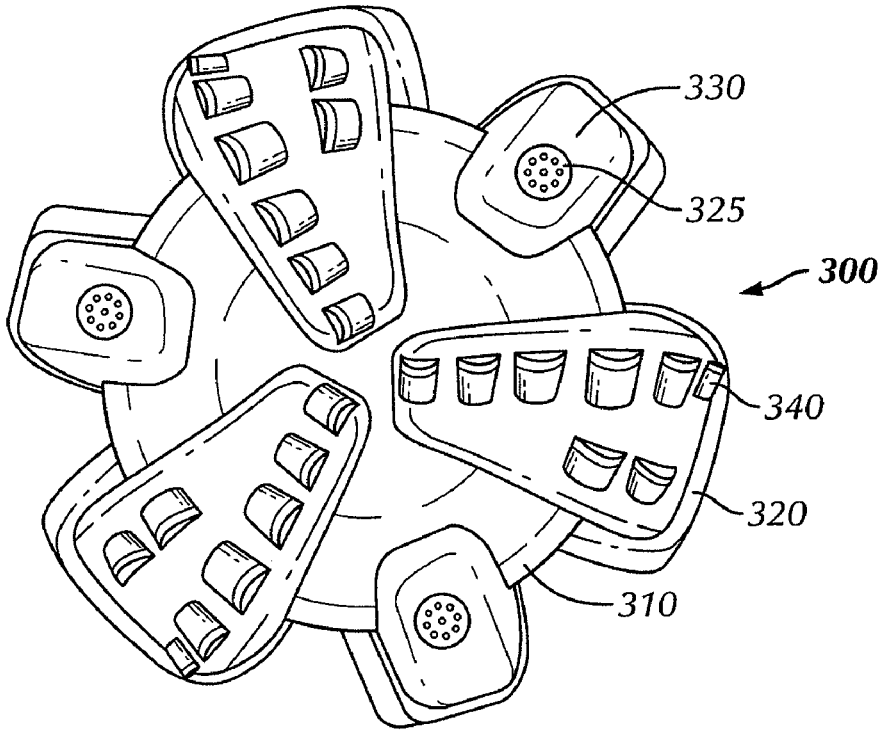
FIG. 3 shows a drill bit comprising utility blades having wear indicators in accordance with embodiments of the present disclosure.

Referring to FIG. 3, a bottom view of a drill bit 300 is shown in accordance with embodiments of the present disclosure. Drill bit 300 comprises a bit body 310, cutting blades 320 extending radially from bit body 310, and cutting elements 340 disposed on cutting blades 320. Drill bit 300 further comprises utility blades 330 extending radially from bit body 310, utility blades 330 being free of cutting elements. Utility blades 330 may comprise wear indicators 325 disposed thereon. Wear indicators 325, as described herein, may be tungsten inserts, diamond enhanced inserts, diamond impregnated inserts, or other material suitable for wear as known to those skilled in the art. Wear indicators 325 may also be PDC cutters with substantially larger bevel size or substantially larger back rake angles than active cutting elements 340. They may also be positioned lower than cutting elements 340 to further reduce their cutting aggressiveness so they act mainly as wear indicators. As shown, wear indicators 325 are mounted on a bottom face of utility blades 330; however, they may alternatively be mounted on a side face, or a gauge diameter formed by outer profiles of utility blades 330. In certain embodiments with wear indicators mounted on the gauge diameter of utility blades 330, the gauge diameter of utility blades 330 may be equal to or slightly less than a gauge diameter formed by outer profiles of cutting blades 320. In one example, the gauge diameter of utility blades 330 may be between about 0.01 inches and 0.15 inches less than the gauge diameter of cutting blades 320. Further, with wear indicators 325 mounted on a bottom face of utility blades 330, a height of utility blades 330 may be equal to or slightly less than the height of cutting blades 320. The utility blades 330 may also be higher than cutting blocks 320, but lower than the cutting profile formed by the cutting elements 340. In embodiments disclosed herein, "cutting action" of cutting elements 340 on cutting blades 320 may occur first, and as cutting elements 340 on cutting blades 320 "wear down" to a certain height, wear indicators 325 may contact a formation being drilled to signal a need to change cutting elements 340. Wear indicators 325 may be attached to utility blades 330 in various ways known to those skilled in the art, including welding, brazing, adhesives, and fasteners.

Figure 4:
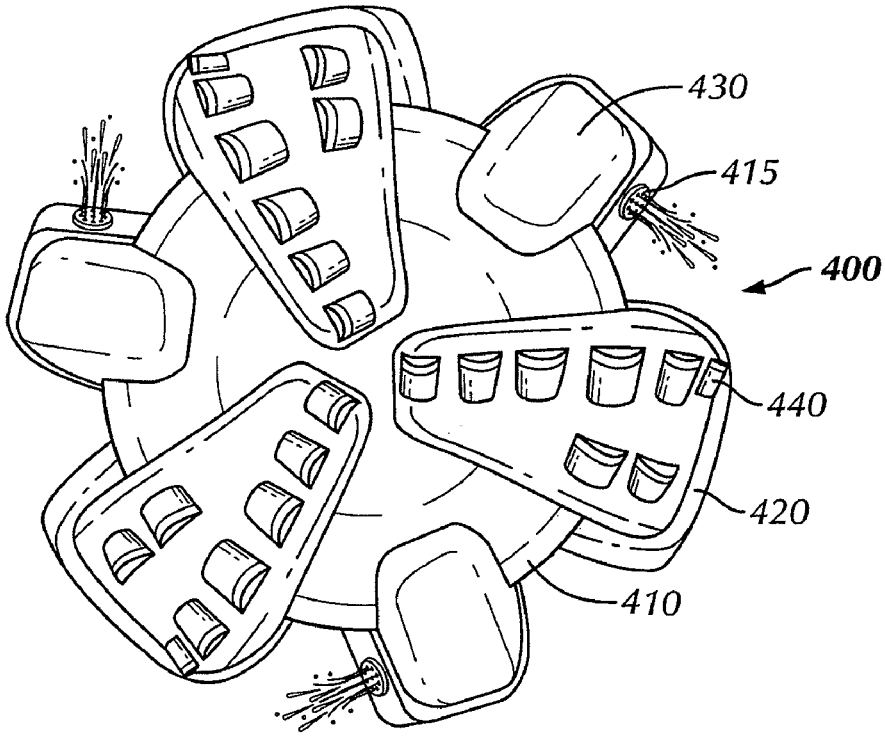
FIG. 4 shows a drill bit comprising utility blades having nozzles in accordance with embodiments of the present disclosure.

Referring now to FIG. 4, an end view of a drill bit 400 is shown in accordance with embodiments of the present disclosure. Drill bit 400 comprises a bit body 410, cutting blades 420 extending radially from bit body 410, and cutting elements 440 disposed on cutting blades 420. Drill bit 400 further comprises utility blades 430 extending radially from bit body 410, utility blades 430 being free of cutting elements. Drill bit 400 comprises flow conduits (not shown) to which flow nozzles 415 are attached, the flow nozzles 415 configured to impinge on cutting elements 440 mounted on cutting blades 420. In certain embodiments, flow nozzles 415 may be configured to impinge on cutting elements 440 towards an outer circumference of drill bit 400. Further, the geometry of utility blades 430 may be changed to determine a flow direction from flow nozzles 415 as desired. In selected embodiments, flow nozzles 415 may be adjustable to concentrate fluid flow from them onto desired cutting elements 440 or areas of cutting blades 420 depending on drilling conditions. Alternatively, drill bit 400 may be used without regular flow nozzles extending through or from a bit body.

The optimal placement, directionality and sizing of the flow nozzles 415 may vary depending on the bit size and formation type that is being drilled. For instance, in soft, sticky formations, drilling rates may be reduced due to "bit balling", or when the formation sticks to the cutting blades. As the cutters attempt to penetrate the formation, they may be restrained by the formation stuck to the cutting blades, reducing the amount of material removed by the cutting element and slowing the rate of penetration (ROP) of the drill bit. In this instance, fluid directed toward the cutting blades may help to clean the cutting elements and cutting blades allowing them to penetrate to their maximum depth, maintaining the rate of penetration for the bit. Furthermore, as the cutting elements begin to wear down, the bit may drill longer because the cleaned cutting elements will continue to penetrate the formation even in their reduced state.

Referring back to FIG. 2, in certain embodiments of the present disclosure, utility blades 230 may be formed from various materials including, for example, the particular bit body material such as steel and a composite matrix material or in other embodiments, may include a diamond impregnated material. For example, diamond impregnated utility blades 230 may be used in combination with PDC cutters on cutting blades 220 for drilling in formations with a mixture of soft and hard layers. Such a material may be formed by using an abrasive material, such as diamond, impregnated into the surface of the material forming the bit body. Typically, bit type may be selected based on the primary nature of the formation to be drilled. However, many formations have mixed characteristics (i.e., the formation may include both hard and soft zones), which may reduce the rate of penetration of a bit (or, alternatively, reduces the life of a selected bit) because the selected bit is not preferred for certain zones. One type of "mixed formation" includes abrasive sands in a shale matrix. In this type of formation, if a conventional impregnated bit is used, because the diamond table exposure of this type of bit is small, the shale can fill the gap between the exposed diamonds and the surrounding matrix, reducing the cutting effectiveness of the bit (i.e., decreasing the rate of penetration (ROP)). In contrast, if a PDC cutter is used, the PDC cutter will shear the shale, but the abrasive sand will cause rapid cutter failure (i.e., the ROP will be sufficient, but wear characteristics will be poor). Thus, when drilling in a mixed formation using a bit of the present disclosure, the PDC cutters may be more efficient, while when drilling in harder layers, the diamond impregnated utility blades may be better suited for grinding away at the formation.

Further, embodiments of the present disclosure may comprise utility blades 230 which contain downhole drilling sensing equipment. For example, mechanical or electronic devices for measuring various properties in the well such as pressure, fluid flow rate from each branch of a multilateral well, temperature, vibration, composition, fluid flow regime, fluid holdup, bit RPM, bit accelerations, etc. may be disposed inside utility blades 230. One of ordinary skill in the art will understand the various options for installing sensors in the utility blades. Further, measurement-while-drilling (MWD) equipment and logging-while-drilling (LWD) equipment to measure formation parameters such as resistivity, porosity, etc. may be installed directly in the utility blades on the drill bit.

Figure 5:
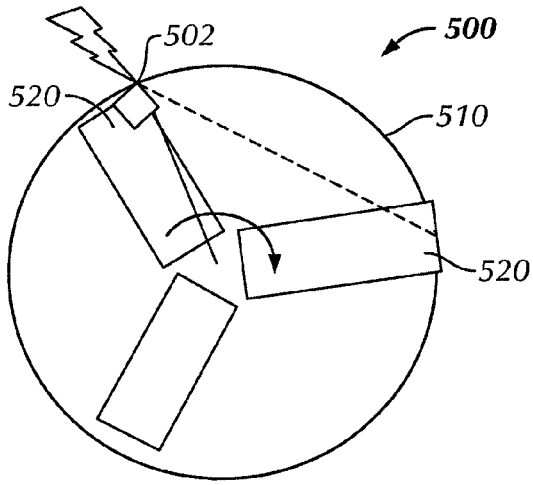
FIG. 5 (Prior Art)
FIG. 5 shows a prior art drill bit without utility blades during drilling.

Further, embodiments disclosed herein may provide a drill bit capable of increased drilling speeds without sacrificing stability. The drilling speed, or rate of penetration (ROP), typically increases with a bit having fewer cutting blades; however, in such a bit, the reduced number of blades leads to increased instability. Thus, bits of the present disclosure may allow for increased ROPs while also maintaining stability. Referring to FIG. 5, a bottom view of a conventional drag bit 500 having three cutting blades 520 extending from a bit body 510 is shown during a downhole drilling operation. As drill bit 500 rotates downhole, torsional vibrations or bit whirl as previously described may cause severe impact loading 502 on cutting blades 520 as shown. Resultant loads at impact point 502 may be large enough to cause damage to cutting blades 520 and cutting elements (not shown) disposed on cutting blades 520.

Figure 6A:
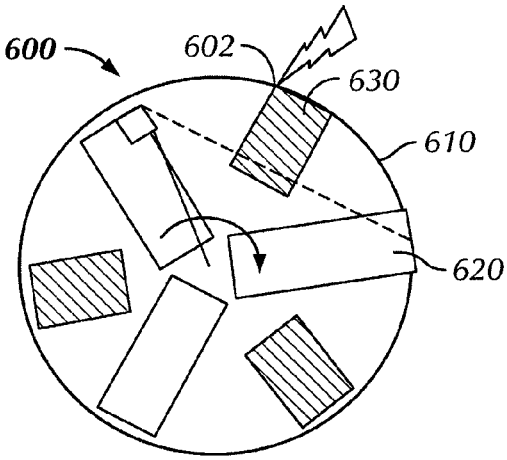
FIG. 6A-6B shows a drill bit comprising utility blades during drilling in accordance with embodiments of the present disclosure.
Figure 6B:
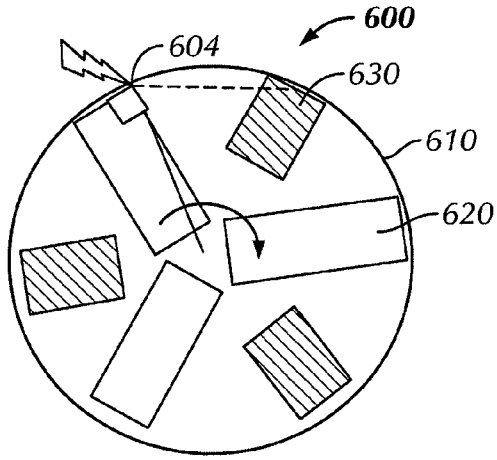

Referring to FIG. 6A, a bottom view of a drill bit 600 in accordance with embodiments of the present disclosure is shown during a drilling operation. Drill bit 600 comprises a bit body 610 and three cutting blades 620 similar to those on conventional bit 500 (FIG. 5) extending radially from bit body 610 with cutting elements (not shown). Furthermore, bit 600 also includes utility blades 630 free of cutting elements extending radially from bit body 610. During drilling, the effects of bit whirl may be reduced by utility blades 630 as they are configured to absorb portions of the impact loading as seen at impact point 602. Referring to FIG. 6B, as drill bit 600 continues to rotate downhole main blades 620 still absorb impact loads, however, they may be significantly reduced as shown at impact point 604.

The utility blades disposed on the bit body may mitigate the magnitude of instability when vibrations occur during the drilling operation. Adding the utility blades to the drill bit may increase the gauge contact area around the circumference of the drill bit providing more contact area between the drill bit and the formation being drilled. For example, the drill bit has more gauge contact area by having six blades (three cutting blades and three utility blades) rather than just three cutting blades. Therefore, the added gauge contact area may increase the stability of the drill bit during drilling operations with reduced impact loads by providing more contact points around the drill bit circumference. Further, rate of penetration of the drill bit may increase due to the reduced vibrations and bit whirl. The less the drill bit is allowed to "wobble" around in the borehole, the faster the bit may drill. The increased rate of penetration (ROP) of embodiments disclosed herein may further reduce drill time and associated drilling costs.

In selected embodiments, utility blades may include "depth of cut" (DOC) or penetration limiters. In an attempt to reduce bit instability, penetration limiters work to prevent excessive cutter penetration into the formation that can lead to bit whirl or cutter damage. These devices may act to prevent not only bit whirl but also prevent radial bit movement or tilting problems that occur when drilling forces are not balanced. As such, penetration limiters may preferably satisfy two conditions. First, when the bit is drilling smoothly (no excessive forces on the cutters), the penetration limiters may not be in contact with the formation. Second, if excessive loads do occur either on the entire bit or to a specific area of the bit, the penetration limiters may contact the formation and prevent the surrounding cutters from penetrating too deeply into the formation.

Further, in selected embodiments, utility blades may include a stabilizer for radially stabilizing the drill bit. The stabilizer may have retractable stabilizing members or may have fixed stabilizing member as will be known to a person skilled in the art. Stabilizer may provide increased drill bit operating life with greater drilling ROP, as well as more predictable and economical drilling through a wide range of different rock and earth formations.

Advantageously, embodiments disclosed herein may provide a drill bit which provides improved data to an operator on downhole drilling conditions during operation. The ability to install sensors directly into the utility blades on the drill bit may provide more accurate and reliable data to operators during a drilling operation, which may increase efficiency and reduce costs of the drilling operation. Valuable downhole conditions during a drilling operation may warn the operator of impending problems developing downhole which would stop the drilling operation before major damage is done. This aspect of the disclosed embodiments may reduce drilling costs dramatically.

Still further, embodiments disclosed herein may provide a drill bit with improved cooling abilities. The various configurations of the flow nozzles in the drill bit may provide for enhanced cooling and cleaning of the cutting elements, such as outer cutting elements that are not typically cleaned or cooled by conventional nozzles. Analysis or simulations may be performed on the drill bit to identify cutting elements lacking proper cooling. With adjustable nozzles disposed in the utility blades, cooling of selected cutting elements may be improved. Further, changing the geometry of the utility blades may provide a desired flow direction on various cutting elements. The improved flow and cooling characteristics may help to increase the life of the cutting elements, thereby reducing maintenance or replacements costs of the cutting elements. Still further, improved flow and cooling of the cutting elements may improve the ROP of the drill bit as well as the stability during drilling operations.

Advantageously, embodiments disclosed herein may provide a drill bit having improved wear indicating features during downhole drilling operations. The wear indicators mounted on the bottom face or the gauge surface of the drill bit may provide more accurate and improved notification of cutting element wear to the operator. This may decrease costs of drilling from damaged bit bodies or drill strings from attempting to drill with insufficient cutting elements. Further, wear indicators may provide added cutting action when cutting elements wear down to a certain point, thereby improving ROP as cutting elements wear down.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A drill bit comprising:

a bit body;

a plurality of cutting blades extending radially from the bit body and having cutting elements disposed thereon, the plurality of cutting blades forming a cutting blade gauge pad diameter configured to contact a formation; and a plurality of utility blades extending radially from the bit body and devoid of cutting elements, the plurality of utility blades forming a utility blade gauge pad diameter configured to contact the formation;

wherein the plurality of cutting blades and the plurality of utility blades are circumferentially spaced having fluid courses that extend therebetween.

2. The drill bit of claim 1, wherein the plurality of cutting blades and the plurality of utility blades are configured in an alternating arrangement about a center of the bit body.

3. The drill bit of claim 1, further comprising wear indicators disposed on the plurality of utility blades.

4. The drill bit of claim 1, wherein at least one of the plurality of utility blades comprises diamond impregnated material.

5. The drill bit of claim 1, wherein at least one of the plurality of utility blades comprises downhole sensing equipment.

6. The drill bit of claim 5, wherein the sensing equipment are configured to monitor drilling parameters selected from a group consisting of pressure, fluid flow rate, temperature, vibration, composition, fluid flow regime, fluid holdup, bit RPM, and bit acceleration.

7. The drill bit of claim 1, wherein at least one of the plurality of the utility blades comprise flow nozzles configured to direct flow onto cutting elements disposed on the cutting blades.

8. The drill bit of claim 1, wherein the utility blade gauge pad diameter is less than the cutting blade gauge pad diameter.

9. The drill bit of claim 8, wherein the utility blade gauge pad diameter is about 0.01 inches to about 0.15 inches less than the cutting blade gauge pad diameter.

10. The drill bit of claim 1, wherein the bit body is steel.

11. The drill bit of claim 1, wherein the bit body is a matrix material.

12. The drill bit of claim 1, wherein the plurality of utility blades further comprises stabilizers.

13. A drill bit comprising:

a bit body;

a plurality of cutting blades extending radially from the bit body and having cutting elements disposed thereon, the plurality of cutting blades forming a cutting blade gauge pad diameter configured to contact a formation;

a plurality of utility blades extending radially from the bit body and devoid of cutting elements, the plurality of utility blades forming a utility blade gauge pad diameter configured to contact the formation;

wherein the plurality of cutting blades and the plurality of utility blades are circumferentially spaced having fluid courses that extend therebetween; and flow nozzles attached to a conduit disposed in the utility blades, the flow nozzles configured to direct flow towards the cutting elements disposed on the cutting blades.

14. A method to achieve improved bit stability in a drill bit while drilling a formation, the method comprising:

rotating the drill bit comprising a plurality of cutting blades having cutting elements disposed thereon alternated with a plurality of utility blades devoid of cutting elements, wherein the plurality of cutting blades and the plurality of utility blades are circumferentially spaced having fluid courses that extend therebetween;

impacting the formation with the plurality of cutting blades; and impacting the formation with the plurality of utility blades.

* * * * *